United States Patent [19]

Toda

[11] Patent Number: 4,733,546

[45] Date of Patent: Mar. 29, 1988

[54] KNITTED FABRIC FOR CLOTHING

[75] Inventor: Kazuhiro Toda, Otsu, Japan

[73] Assignee: Toray Industries, Inc., Tokyo, Japan

[21] Appl. No.: 18,827

[22] Filed: Feb. 24, 1987

Related U.S. Application Data

[63] Continuation of Ser. No. 583,501, Feb. 24, 1984, abandoned.

[51] Int. Cl.[4] ..... D04B 7/16

[52] U.S. Cl. ..... 66/202; 66/196; 66/195

[58] Field of Search ..... 66/202, 196, 185, 186, 66/187, 195; 2/115

[56] References Cited

U.S. PATENT DOCUMENTS

| | | | |
|---|---|---|---|
| 2,842,947 | 7/1958 | Lindner | 66/202 |
| 3,115,693 | 12/1963 | Chandler | 28/78 |
| 3,250,095 | 3/1966 | Bird | 66/202 |
| 3,408,833 | 11/1968 | Fredrick et al. | 66/178 |
| 3,828,585 | 8/1974 | Thorneburg | 66/202 |
| 4,137,615 | 2/1979 | Webster | 28/218 |
| 4,144,727 | 3/1979 | Duhl et al. | 66/192 |
| 4,195,497 | 4/1980 | Goldstein | 66/185 |
| 4,216,662 | 8/1980 | Harris et al. | 66/186 |
| 4,253,299 | 3/1981 | Borenstein et al. | 28/274 |
| 4,267,710 | 5/1981 | Imamichi | 66/196 |
| 4,345,425 | 8/1982 | Wegishi et al. | 28/274 X |
| 4,467,626 | 8/1984 | Coble et al. | 66/196 |
| 4,487,040 | 12/1984 | Patel et al. | 66/195 |
| 4,571,960 | 2/1986 | Hurshi et al. | 66/196 |

FOREIGN PATENT DOCUMENTS

| | | | |
|---|---|---|---|
| 2530800 | 1/1977 | Fed. Rep. of Germany | 66/196 |
| 2459851 | 1/1981 | France | 66/196 |
| 5959951 | 9/1982 | Japan | 66/196 |
| 400429 | 4/1966 | Switzerland | 66/196 |

OTHER PUBLICATIONS

Joseph, M. L. "Introductory Textile Science", 3rd Ed. 1977, Holt, Rinehart & Winston pp. 233–234.

Goswami et al, "Textile Yarns Technology & Applications" 1977, John Wiley & Son, pp. 382–385.

*Primary Examiner*—Ronald Feldbaum

*Attorney, Agent, or Firm*—Wegner & Bretschneider

[57] ABSTRACT

A knitted fabric having a multi-layered structure made of non-hygroscopic fiber yarn, such as synthetic yarn, in which the inter-fiber space in a yarn composing a surface layer is smaller than that in a yarn composing a back layer. The size of the inter-fiber space can be controlled by varying the fiber fineness, knitted structure, and/or yarn type composing each of the layers. The fabric according to the present invention has good water-permeability and water-diffusibility and, therefore, is suitable for sportswear.

24 Claims, 20 Drawing Figures

KNITTED FABRIC FOR CLOTHING

This application is a continuation of U.S. application Ser. No. 583,501, filed Feb. 24, 1984, now abandoned.

BACKGROUND OF THE INVENTION

1. Field of the Invention

The present invention relates to a knitted fabric of a multi-layered structure made of non-hygroscopic fiber yarn, such as synthetic fiber yarn, but excellent in water-permeability and water-diffusibility. More specifically, the present invention relates to a knitted fabric suitable for making sports wear having good sweat-removal ability, heavy duty durability, aesthetic appearance, and wash-and-wearability.

2. Description of the Prior Art

Fabrics utilized for sportswear such as sportsshirt, warm-up suits, sweatsuits, and sports-pants preferably feature good elasticity and light weight for easy wearer movement. Knitted fabrics, therefore, command a large share of the sportswear market.

Knitted fabrics utilized for sportswear include fabrics of 100% natural fiber yarn, such as cotton or wool, 100% synthetic fiber yarn, such as polyester or polyamide, and combinations of natural and synthetic fiber yarn.

Since sportswear is often worn directly on a wearer's body, which gives off considerable sweat during sports activity, sportswear must be able to easily absorb sweat and transfer it to its outer surface for evaporation in the open air. Sportswear must also withstand heavy duty wear and has a characteristic of wash and wear for frequent laundering.

Up until now, no fabric has possessed all of the above-mentioned properties. For example, 100% natural fiber yarn fabric can absorb sweat well due to its excellent hygroscopic property, but cannot quickly transfer it outside for evaporation therefrom. Moreover, after laundering, it holds a considerable amount of water even after spin-drying, thus needs much time for complete drying.

Conventional 100% synthetic fiber yarn fabric, on the other hand, has good wash-and-wearability, but imparts an uncomfortable wet feeling to the wearer because the secreted sweat remains on the wearer's skin and/or inner surface of the fabric due to its poor water-absorbing speed.

A fabric composed of mixed spun yarn or mixed filament yarn or a fabric composed of yarns consisting of natural fiber and synthetic fiber yarns has a fair wash-and-wearability, but the wash-and-wearability is insufficient for sports wear usage. In addition, natural fiber and synthetic fibers have different physical and chemical properties, especially in dyeability or thermal properties. Therefore, uniform dyeing and complete heat-setting of the above-mentioned fabric composed of the both fibers cannot be obtained.

Japanese Examined Utility Model Publication (Kokoku) No. 56-23282 discloses a quilted diaper comprising a sheet composed of an ultra-fine fiber having a fineness within a range of from 0.01 to 0.5 denier. The sheet is covered with a fabric composed of a course fiber having a fineness within a range of from 1 to 5 denier over both sides thereof. Japanese Unexamined Patent Publication (Kokai) No. 52-25168 proposes an absorbent fabric having an intermediate layer of ultra-fine fibers of less than 0.7 denier covered with a surface layer of coarse fiber of more than 1 denier, in which the ratio of fineness between the two fibers is more than 4 and the fiber surfaces are processed by hydrophilic treatment.

The former diaper, however, is aimed only to absorb and hold water in the ultrafine fiber sheet. Therefore, though a wet feeling on the wearer's skin can be avoided because the water is immediately removed from the skin through the surface layer, the water absorbed in the sheet cannot easily evaporate therefrom. Thus, the material of the above diaper is unsuitable for sportswear. In addition, the material is too thick and heavy as well as poor in stretchability due to quilting.

On the other hand, the latter absorbent fabric lacks durability against abrasion, pilling, and snagging because the surface layer is composed of a yarn made from ultrafine fibers of less than 0.7 denier, which are easily damaged by external force applied to the fabric surface. In addition, the fabric has a high water-holding ability due to fine space or void provided among the fibers composed of the yarn or a group of fibers, which is referred as inter-fiber space hereafter in short, formed in the fine fiber layer. Therefore, though the drying speed of the fabric is superior to that of a natural fiber fabric in which a fiber itself has hygroscopic property, it is still insufficient to fulfill the requirement of so-called 'wash and wear' property. Further, the fine fiber of less than 0.7 denier utilized for the above-mentioned fabric, which is preferably manufactured by a process proposed in Japanese Examined Patent Publication (Kokoku) No. 44-18369, is rather expensive and, therefore, is unsuitable for mass-consumption goods such as sportswear.

SUMMARY OF THE INVENTION

It is an object of the present invention to eliminate the above drawbacks of the prior art.

It is another object of the present invention to provide a knitted fabric suitable for sportswear use, excellent in water-permeability and water-diffusibility, whereby secreted sweat can be easily transferred from the inside to outside.

It is a further object of the present invention to provide as knitted fabric having good wash-and-wearability as well as durability against pilling and snagging.

The above objects of the present invention can be attained by a knitted fabric having at least two layers made from yarns mainly composed of non-hygroscopic fiber of at least 1 denier, characterized in that the inter-fiber space of a yarn in one layer differs from that in the other layer. That is, the fabric according to the present invention is not composed of a yarn made from natural fiber such as cotton, wool or other materials having an inherently hygroscopic property but is composed of a yarn made from non-hygroscopic fiber. The fabric according to the present invention is formed with a hygroscopic property by capillary action of a void between adjacent fibers composing the yarn, i.e., inter-fiber space. To achieve this hygroscopic property, an inter-fiber space of a first yarn forming one layer of the fabric is made with a different size from that of a second yarn forming the other layer thereof. The difference in inter-fiber space size can be imparted by suitably selecting the structure of the yarn forming the respective layers and the fineness of the fiber composing the yarn and the fabric structure itself. Due to this double-layered structure of fabric, sweat secreted from the wearer's skin can be absorbed by the back layer and, then transferred to the surface layer by diffusion for evaporation in the open air. In this specification, the term "back layer" means an inner side layer adjacent to a wearer's body when the fabric is used as clothing, and the term "surface layer" means the layer on the opposite side to the former.

BRIEF DESCRIPTION OF THE DRAWINGS

These and other objects of the invention will be made clearer by referring to the description of a preferred embodiment, made in reference to the accompanying drawings, in which:

FIGS. 1A, 1B, and 1C are schematic sectional views illustrating the water-transferring function of various capillary models having two layers, in which FIGS. 1A and 1B illustrate comparative models and FIG. 1C shows a preferable model for the present invention, and in which $M_1$, $M_2$ indicate a capillary (in other words, inter-fiber space in the fabric of the present invention);

DESCRIPTION OF THE PREFERRED EMBODIMENT

The present inventor has studied the relationship between the size of a yarn forming the inter-fiber space of a knitted fabric and the water-transferring ability thereof and found preferable combinations of various factors for imparting suitable properties to the fabric for sportswear use.

Generally speaking, synthetic fiber has an inferior water-absorbing ability compared with natural fiber such as cotton or wool. With a few exceptions, synthetic fiber can hold almost no water in its microscopic structure. This is a main reason why a fabric composed of synthetic fiber has good wash-and-wearability but poor sweat-absorbing ability.

For sportswear, it is more important for a fabric to quickly transfer sweat from the human skin to the outer surface of the fabric rather than to absorb and hold the sweat in the fiber microscopic structure.

The principle behind the present invention is capillary action. Capillary action is often observed in nature. For example, in a tree, water is transferred upward against gravity from a root through a stem to a branch, then to a twig, and, in turn, to a leaf.

Physics teaches that liquid rises in a fine tube to a height h defined by the following equation:

$$h=2\nu \cos \theta/\gamma\rho g$$

where $\gamma$=radius of the tube, $\rho$=density of the liquid, $\nu$=surface tension of the liquid, $\theta$=contact angle, and g=gravitational acceleration. Thus, a tube can suck a liquid therein against gravity with a force inversely proportional to its radius.

Capillary action of various double-layered models are explained with reference to FIGS. 1A to 1C.

Figure 1:
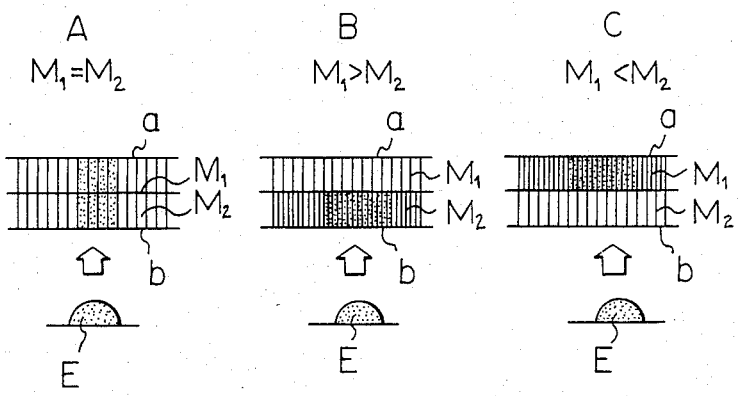

FIG. 1A shows a first model having surface layer a and back layer, each of which is composed of a plurality of the same radius capillaries $M_1$, and $M_2$. When a small volume of liquid E is supplied on the back layer b, the liquid E is absorbed into the layer b by capillary action. A part of the liquid E in layer b can be permeated the surface layer a by capillary action, though a considerable amount of the liquid remains in the back layer b.

FIG. 1B shows a second model, in which a back layer b is composed of a plurality of finer capillaries $M_2$ and a surface layer a is composed of a plurality of coarser capillaries $M_1$. In this case, though the liquid E is absorbed by the back layer b, it cannot transfer into the surface layer a because the radius of the latter is larger than that of the former. Therefore, all the liquid E remains in the back layer b.

FIG. 1C shows a third model, on which the present invention relies, having a reverse structure to that shown in FIG. 1B. In this case, the liquid E is absorbed in the back layer b, than is all transferred to the surface layer a due to the stronger action of the finer capillaries. Therefore, the back layer b does not hold any liquid therein.

A knitted fabric according to the present invention is composed of yarns made of non-hygroscopic fibers having fineness of at least 1 denier. The non-hygroscopic fibers used in the present invention include synthetic fiber such as polyester, polyolefin, polyacrylonitrile, or polyamide fiber. Fiber of at least 1 denier is advantageous because it is widely available on the market and has good resistance against external force.

The yarn may be a non-textured multi-filament yarn, a textured yarn (preferably a false-twist textured yarn), or a spun yarn. The yarn can be selectively utilized corresponding to the desired use of the fabric.

A knitted fabric according to the present invention has a specific double-layered structure in which the yarn forming one layer has smaller inter-fiber space comparing with a yarn forming another layer. More generally speaking, at least one layer of a knitted fabric is composed of yarns which fibers form rather smaller inter-fiber spaces than those of yarns composing another layer thereof. Such a feature can be obtained by selecting a suitable combination of yarns from the above groups and/or by adopting a suitable knitting plan.

To enhance the water-absorbing ability of the yarn, the use of hygroscopic treatment over a fiber or a yarn is preferable and additional adaptation of such a physical treatment of at least one layer surface as raising, buffing, or shearing etc is also preferable.

The present invention may be applied to various types of knitted fabrics, so long as the above layered structure can be obtained, such as single jersey, double jersey, single tricot, single raschel, double tricot, or double raschel.

Typical embodiments of the fabric structure are as follows:

(a) A double jersey in which a yarn forming the back layer thereof also constitutes a connecting yarn connecting the surface layer to the former layer, as described later in Example 1.

Figure 2:
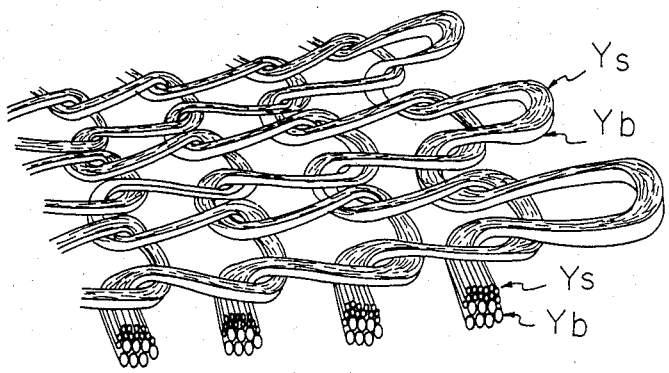
FIG. 2 is a perspective view of a fabric according to the present invention.

(b) A single jersey in which yarns forming both surface of the jersey are composed of at least two different kinds of yarns closely parallel to each other in the whole knitting portion. Such a fabric can be obtained by so-called plaiting method. In that method, at least two yarns having different inter-fiber spaces are simultaneously fed to the same needle of the knitting machine, whereby a fabric illustrated in FIG. 2 can be obtained. As apparent from FIG. 2, a yarn $Y_s$ composed of finer fibers is always positioned above another yarn $Y_b$ composed of coarser fibers, resulting in the double-layered fabric. In this case, the one layer composed of a yarn $Y_s$ made of fibers having rather finer fineness which can provide rather smaller inter-fiber space relative to the another layer composed of a yarn $Y_b$ made of fibers having rather larger fineness.

Figure 7:
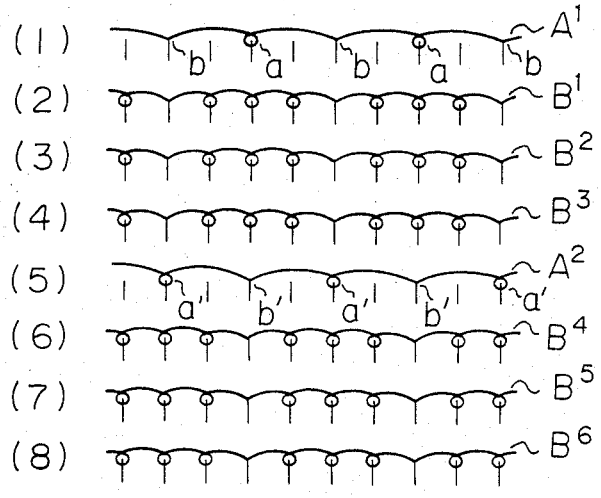
FIG. 7 is another knitting construction of a single jersey according to the present invention.
Figure 8:
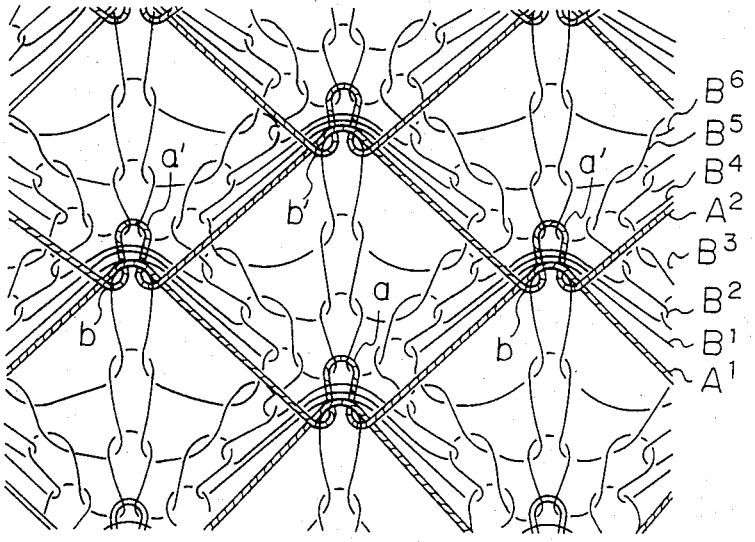
FIG. 8 is a diagrammatic sketch illustrating a back surface of a fabric produced by the construction shown in FIG. 7.
Figure 14A:
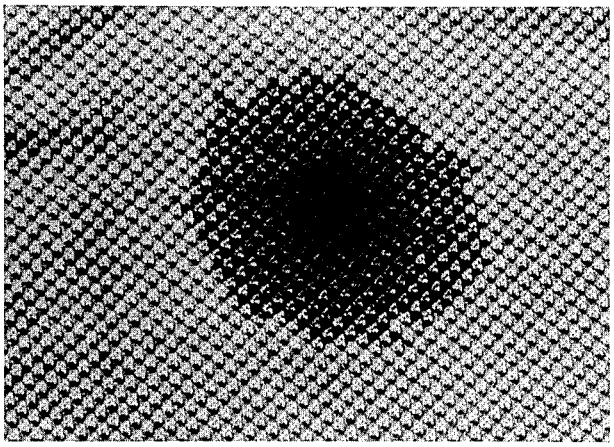
FIGS. 14A and 14B are photographs showing results of the ink spot test in Example 4.
Figure 14B:
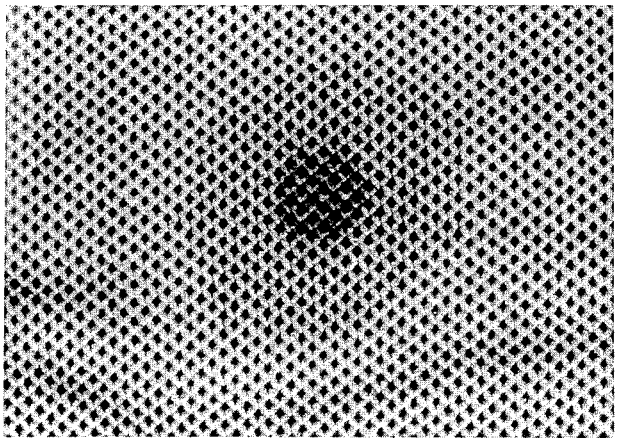

The difference of the inter-fiber spaces can even be obtained using the same kind and type of the yarn for the two layers. This is based on the fact that the inter-fiber space tends to decrease as the constraint upon the yarn increases, and vice versa. Accordingly, it is possible to obtain a relative difference between the inter-fiber space in a yarn forming one layer and that in a yarn forming the other layer by adopting a fabric structure having different constraining forces on the layers. Embodiments thereof are as follows:

(c) A single jersey in which at least one layer is formed by projected sinker loops arranged along a geometric linear pattern as shown in FIGS. 7 and 8. FIG. 8 illustrates a diagrammatic sketch of the appearance of the back layer of a single jersey knitted with a design shown in FIG. 7. The above-said projected sinker loops arranged along a geometric linear pattern are identical to sinker loops formed by linearly arranged yarns $A^1$ and $A^2$ in FIG. 8. These sinker loops constitute the back layer. The other layer is formed by needle loops of yarns $B^1$, $B^2$, $B^3$, $B^4$, $B^5$, and $B^6$; and needle loops of $A^1$ and $A^2$, in which layer the yarns forming the layer are made to be compact due to a binding force exerted on the respective needle loops due to interconnection therebetween, i.e., a pattern restraint force, whereby the inter-fiber space in the respective yarns becomes small. On the contrary, the yarns forming the above-said projected sinker loops in the back layer are not subjected to such a large pattern restraint force and, therefore, the yarn structure becomes relatively loose and the large inter-fiber space is obtained. This difference can be confirmed by observation of the yarn configurations shown in FIGS. 14A and 14B, illustrating enlarged photographs of the surface layer and of the back layer, respectively.

Figure 9:
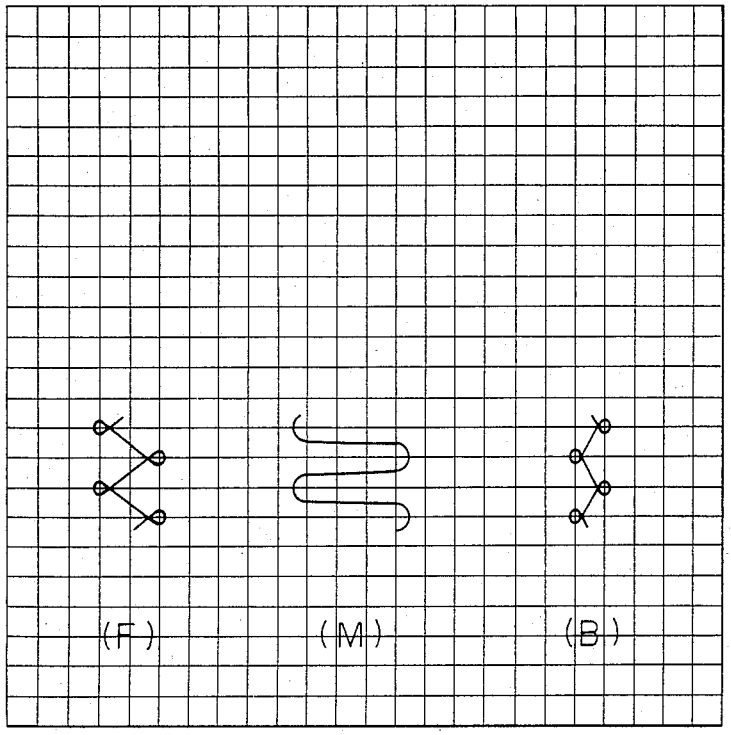
FIG. 9 is a knitting construction of a single tricot according to the present invention.

(d) A single tricot knitted by means of a tricot machine having three or four guide bars, in which an inlaid warp forming no loops is inserted between front and back warps. FIG. 9 illustrates a pattern design for obtaining an embodiment of the above fabric structure, in which (F) designates a movement of the front guide bar; (M) a movement of the middle guide bar; and (B) a back guide bar. In this structure, the back layer is formed by a yarn inlaid in the structure by the middle guide bar and the surface layer is formed by yarns guided by the front and back guide bars. The inlaid warps is exposed outside through one group of the remaining warps, thus forming the back layer. By using a similar technique, a double-layered mesh fabric can be obtained.

Common to the above embodiments, one surface layer may be of a rugged surface so that the layer may make point-contact with the wearer's skin. This point-contact can lessen the uncomfortable cold and wet feeling when sweat has been secreted.

The inter-fiber space can be controlled by selecting the fineness of the fiber composing the yarn. Generally speaking, the finer the fiber, the smaller the inter-fiber space, and vice versa. In the present invention, a yarn of a finer fiber is often used as a yarn composing the surface layer for the purpose of quick transferring of sweat absorbed in a back layer to the surface layer. This arrangement of the yarn, however, is not so preferable for the purpose of "touch" on the wearer's skin and of durability against pilling and snagging.

To obtain a balance between the above contradictory factors, it is preferable to use a yarn composed of from 1.0 denier to 2.5 denier fibers for a surface layer and another yarn composed of fiber having a denier value 50% or more larger than that of the fiber composing the surface layer for a back layer. However, the aimed effect can be achieved by using the same fineness of fiber in both layers with combining different type of yarn construction such as a non-textured yarn and a textured yarn; a filament yarn and a spun yarn; or a bulky yarn and a non-bulky yarn; and with combining yarns of different twist, thereby achieving different inter-fiber spacing in the yarns of the back layer as the yarn of the surface layer.

As a surface layer yarn, it is preferable to use an interlaced yarn having a plurality of compact portions along the longitudinal direction produced by means of the high-speed fluid-ejecting nozzle proposed in Japanese Examined Patent Publication (Kokoku) No. 53-18614 and the composite yarn proposed in Japanese Unexamined Patent Publication (Kokai) No. 55-67024, obtainable by treating a textured yarn and a non-textured yarn together in the above nozzle.

The sectional configuration of the fiber utilized for the present invention is not limited and may be circular, triangular, polygonal, Y-shaped, H-shaped or petal-shaped, selected in accordance with need. It is possible to impart a difference of inter-fiber spacing of the years of one layer and the yarns of another layer by selecting suitable sectional configurations.

The back surface of the fabric according to the present invention may be processed by mechanical treatment such as raising or buffing so that the fiber composing the back surface is opened and cut to have a plush-like appearance and large inter-fiber space.

If necessary, the yarn may be processed by hygroscopic treatment using a surface active agent for enhancing the sweat-absorbing ability.

According to the present invention, since the fiber of the yarn composing the layers is of at least 1.0 denier, the fabric thus produced has good durability against pilling and snagging and excellent form-stability. Further, the material cost is less compared to a case using a fine denier fiber of less than 1.0 denier.

Of course, this fabric has good air-permeability and stretchability common to an ordinary knitted fabric and can be produced to be of any desired weight in accordance with its purpose.

The fabric according to the present invention can be utilized for running shirts, athletic wear for tennis, golf, soccer, rugby, basketball, volleyball, baseball, and so on, warm-up suits, training pants, or the like.

EXAMPLE 1

Figure 3:
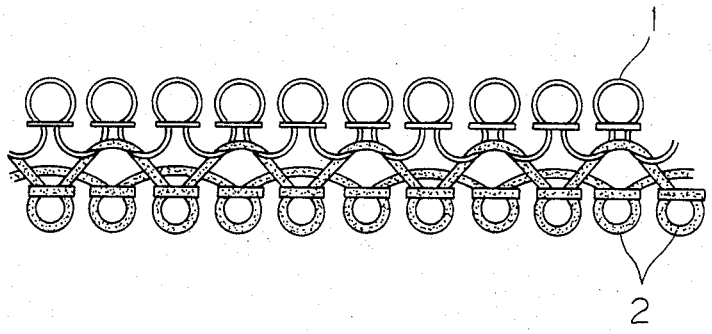
FIGS. 3 and 4 are schematic sectional views along the course direction of double jersey knits according to the present invention.
Figure 4:
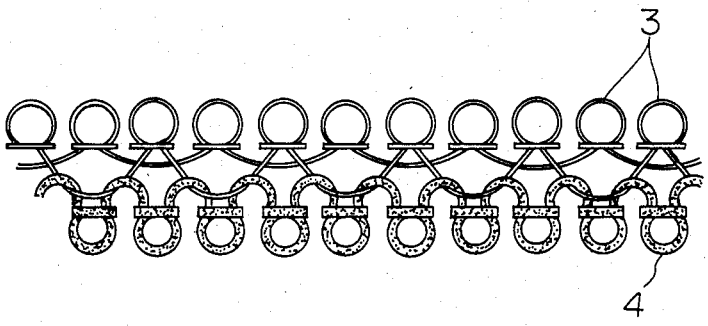

Twelve double jerseys having structures shown in FIGS. 3 and 4 were produced by a 22 gauge interlock circular knitting machine. In the drawings, one side of the fabric constituted by yarn 1 or 3 is assumed to be a "surface" layer and the other side constituted by yarn 2 or 4 is assumed to be a "back" layer. Various combinations of yarns were selected from five kinds of polyester textured yarn of 100 total denier composed of 18, 24, 48, 72 and 96 filaments, respectively. Resultant greige fabrics were refined and heat set under ordinary conditions.

An ink-spot test for evaluating water-permeability and water-diffusibility was carried out on a test piece from the finished fabric as follows:

1. Drop 0.1 cc of an ordinary writing ink diluted by the same volume of water on a glass plate.
2. Lay the test piece above the glass plate so that the back layer thereof can directly touch the ink and keep it stationary for 60 seconds for absorbing the ink.
3. Transfer the test piece from the glass plate onto another glass plate and again keep it stationary for 3 minutes, maintaining the back layer under the surface layer.
4. Measure areas of the ink spots on the layer and back layer of the test piece and calculated the ratio thereof.

A broader area of the ink spot on the surface layer means a better water-diffusibility of the test piece and the larger ratio thereof means a better water-permeability of the back layer.

The test results are listed in Table 1, wherein Test Nos. A to I are the present invention and J to L are blanks.

From the table, it is apparent that examples according to the present invention show better results than the comparative one. The ratio of fiber fineness is necessarily more than 1.5, preferably more than 2.0.

It should be noted that Example D shows an inferior result than Example C, though they both have the same yarn composition. This is caused by the difference of the knitting structures. That is, Example C, having the structure shown in FIG. 3, has a connecting yarn composed of fibers having rather large fineness, while Example D, having the structure shown in FIG. 4, has that of a finer fiber. In this respect, the knitting structure of FIG. 3 is preferable. This is also true for Example E and F. However, Examples D and E having the structure shown in FIG. 4 have a fiber fineness ratio of 4.0 and 3.0, respectively, which ratios are still in the preferable range. Therefore, Examples D and E are sufficient to produce a fabric according to the present invention, even though slightly inferior to Examples C and E.

TABLE 1

| Test No. | Knitting structure | Yarn combination (fiber fineness: denier) | Ratio of fiber fineness | Fabric weight (g/m$^2$) | Ink drop test: Area on surface (cm$^2$) | Ink drop test: Area on back (cm$^2$) | Ink drop test: Ratio |
|---|---|---|---|---|---|---|---|
| A | FIG. 3 | 1 100D 96F (1.04)<br>2 100D 18F (5.56) | 5.33 | 278 | 9.25 | 1.33 | 6.95 |
| B | " | 1 100D 72F (1.39)<br>2 100D 18F (5.56) | 4.00 | 279 | 9.00 | 1.31 | 6.87 |
| C | " | 1 100D 96F (1.04)<br>2 100D 24F (4.17) | 4.00 | 276 | 10.20 | 1.55 | 6.56 |
| D | FIG. 4 | 3 100D 96F (1.04)<br>4 100D 24F (4.17) | 4.00 | 278 | 3.79 | 1.55 | 2.45 |
| E | FIG. 3 | 1 100D 72F (1.39)<br>2 100D 24F (4.17) | 3.00 | 279 | 6.60 | 1.45 | 4.55 |
| F | FIG. 4 | 3 100D 72F (1.39)<br>4 100D 24F (4.17) | 3.00 | 279 | 3.50 | 1.80 | 1.94 |
| G | FIG. 3 | 1 100D 48F (2.08)<br>2 100D 18F (5.56) | 2.67 | 280 | 6.50 | 1.46 | 4.45 |
| H | " | 1 100D 48F (2.08)<br>2 100D 24F (4.17) | 2.00 | 279 | 5.00 | 1.59 | 3.13 |
| I | " | 1 100D 72F (1.39)<br>2 100D 48F (2.08) | 1.50 | 278 | 3.90 | 1.60 | 2.43 |
| J* | " | 1 100D 24F (4.17)<br>2 100D 18F (5.56) | 1.33 | 279 | 1.68 | 1.62 | 1.04 |
| K* | " | 1 100D 24F (4.17)<br>2 100D 24F (4.17) | 1.00 | 278 | 2.00 | 2.50 | 0.80 |
| L* | " | 1 100D 48F (2.08)<br>2 100D 48F (2.08) | 1.00 | 278 | 3.10 | 3.10 | 1.00 |

Note:
Asterisk indicates blank.

$$\text{Ratio of fiber fineness} = \frac{\text{The titer of single fiber in yarn 2 or 4}}{\text{The titer of single fiber in yarn 1 or 3}}$$

D stands for the total denier of the yarn and F stands for the number of filaments in the yarn.

EXAMPLE 2

Figure 5:
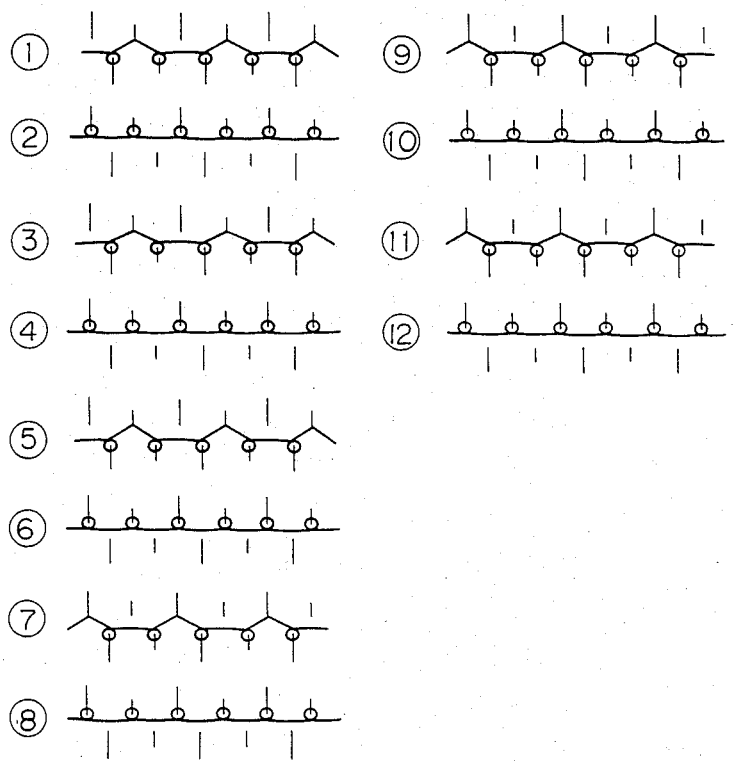
FIG. 5 is a knitting construction of a double jersey according to the present invention.
Figure 6A:
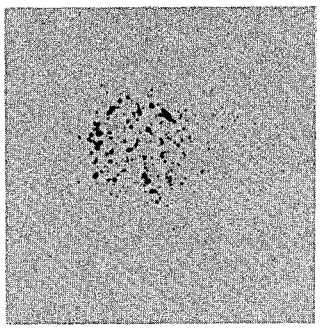
FIGS. 6A to 6F are photographs showing results of the ink spot test in Example 3.
Figure 6B:
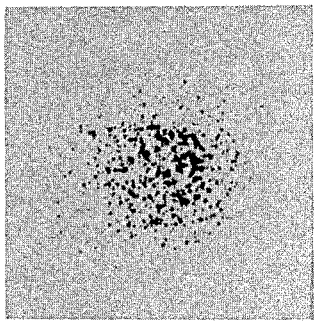
Figure 6C:
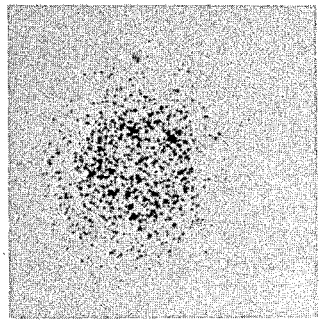
Figure 6D:
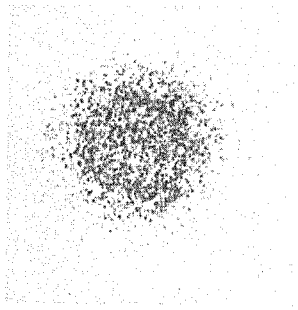
Figure 6E:
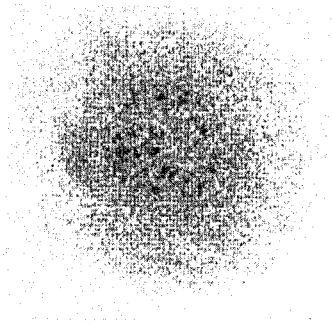
Figure 6F:
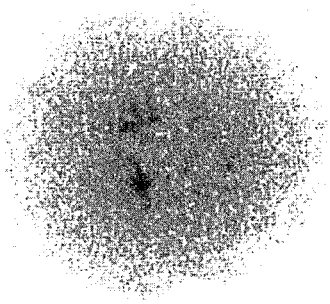

A double jersey was produced by a 28 gauge interlock circular knitting machine, according to a knitting construction shown is FIG. 5, with a polyester textured yarn of 75 total denier composed of 36 filaments and the same type yarn of 75 total denier composed of 72 filaments. The former yarn was fed to feeder Nos. 1, 3, 5, 7, 9 and 11 for forming a back layer, and the latter yarn was fed to Nos. 2, 4, 6, 8, 10, and 12 for forming a surface layer, as shown in FIG. 5. The resultant greige fabric was dyed in a conventional manner (Example M).

Blank N was prepared under the same conditions as Exampel M, except for replacing the surface layer yarn with the same type yarn of 75 total denier composed of 96 filaments.

A test of durability against pilling and snagging was carried out on the two fabrics, results of which are listed in Table 2. From the table, it is apparent that blank N having a surface layer of less than 1.0 denier fiber is inferior in durability compared to Exampel M. In addition, a T-shirt made of Example M in such a condition that the back layer thereof is positioned inside can effectively transfer the sweat outside during jogging.

The above durability test was carried out as follows:

Durability against pilling was decided by 5 hour's evaluation according to the ICI method.

Durability aginast snagging was measured by a snagging tester manufactured by K. K. Daiei Kagaku Seiki Seisakusho, Japan. The evaluation grades are shown below.

Third grade: No snags are observed.

Second upper grade: Few snags are observed.

Second lower grade: Considerable snaggs are observed.

First grade: Many snags are observed.

TABLE 2

| Test No. | Pilling durability | Snagging durability |
|---|---|---|
| M | 3rd grade to 4th | 2nd upper grade |
| N | 2nd grade | 1st grade |

EXAMPLE 3

Six plaiting knits of plain stitch having the structure shown in Table 3 were produced by a 28 gauge single circular knitting machine with a plurality of pairs of polyester textured yarn of 75 total denier selected from a group of five kinds of filament composition of 12, 24, 36, 48, and 72 filaments. The greige fabrics thus obtained were refined and heat-set under ordinary finishing conditions, whereby test pieces of four examples P to S and two blanks T and U were prepared.

An ink spot test using blotting paper was carried out on the test pieces as a measure of water-permeability as follows:

1. Drop 0.1 cc of ordinary writing ink diluted by a double volume of water on a glass plate.
2. Lay a test piece over the glass plate so that the back layer thereof can directly touch the ink and keep it stationary for 60 seconds for absorbing the ink.
3. Transfer the test piece from the glass plate to an wooden plate in such a way that the back surface layer of the test piece including ink comes reversely to upper side and, after that, lay blotting paper thereon.
4. Press the blotting paper once on the test piece by a roller coated with hard rubber having a weight of 1.46 kg, a diameter of 53 mm, and a length of 101 mm, thereby printing the ink spot on the back layer onto the blotting paper. FIGS. 6A, 6B, 6C, 6D, 6E, and 6F illustrate photographs of the fabrics obtained by test Nos. P, Q, R, S, T, and U, respectively.

The printing size of the ink spot on the blotting paper is an indication of wet condition of the back layer, namely a contacting surface with human skin. That is, it is construed that a back surface layer thereof is not in wet condition in the case of the printing size of ink spot being very small. That is, a smaller size ink spot means less wetness on the back layer, and vice versa.

Apart from the above ink spot test, a sensory test for wet feeling was carried out on the test piece absorbing the ink according to the above step 2, and thereafter the wet condition of the back layer of the test piece was examined, results of which are listed in Table 3.

TABLE 3

| Test No. | Fabric composition: Surface layer yarn ($Y_s$) | Fabric composition: Back layer yarn ($Y_b$) | Ratio of fiber fineness ($Y_b/Y_s$) | Fabric weight ($g/m^2$) | Sensory test |
|---|---|---|---|---|---|
| P | 75D 72F | 75D 12F | 6.0 | 157 | 1 |
| Q | 75D 48F | 75D 12F | 4.0 | 157 | 2 |
| R | 75D 72F | 75D 36F | 2.0 | 157 | 2 |
| S | 75D 48F | 75D 24F | 2.0 | 157 | 2 |
| T* | 75D 36F | 75D 72F | 0.5 | 157 | 3 |
| U* | 75D 12F | 75D 72F | 0.17 | 157 | 3 |

Note:
(1) Asterisk indicates comparative test.
(2) Grades of sensory test are as follows.
1: Wet feeling is not observed at all.
2: Somewhat wet feeling is observed.
3: Considerable wet feeling is observed.
(3) Ink drops used in ink drop test were completely absorbed into the knitted fabrics in all cases.
(4) D stands for the total denier of the yarn and F stands for the number of filaments in the yarn.

Table 3 shows that a test piece having a back layer consisting of fibers having larger fineness than that of fibers in surface layer has good water-permeability and less wet feeling. Moreover, it can be understood that the ratio of fiber fineness ($Y_b/Y_s$) fallen in the preferable range of the present invention as mentioned above seems to be proper for the object according to the present invention. In the above test, a needle loop side of a knitted fabric which is ordinarily called as front surface of a knitted fabric is used as surface layer and a sinker loop side thereof ordinarily called as a back layer though we could get the same effect as mentioned above even when the two layers are reversely formed.

EXAMPLE 4

A single jersey was produced according to a knitting construction shown in FIG. 7 by a 28 gauge single circular knitting machine. The yarns $B_1$ to $B_6$ were polyester false-twist textured yarns of 150 total denier composed of 48 filaments, and the yarns $A_1$ and $A_2$ were polyester false-twist textured yarns of 300 total denier composed of 96 filaments. The resultant fabric had a back layer composed of floating yarns $A_1$ and $A_2$ at the sinker loop side. The floating yarns were projected from the fabric body and arranged along a geometric linear pattern as shown in FIG. 8. The fabric, then, was refined and heat set. The ink spot test was carried out on the finished fabric in the same manner as described in Example 1, except the keeping time in step 3 was 10 minutes.

Ink spots on the surface and back layers were photographed, as shown in FIGS. 14A and 14B, respectively.

The photographs show that the ink permeated through the fabric from the back layer to the surface layer while diffusing widely in the latter. This is evidence that an surface layer has a good water-holding ability. Accordingly, the effect of the present invention can be attained by giving a differential inter-fiber spacing the yarns of one layer and the yarns of another layer with adopting a special knitting construction.

EXAMPLE 5

A single tricot fabric was produced in accordance with a knitting construction shown in FIG. 9 by a 28 gauge tricot machine. In this example, non-textured polyester multi-filament yarns (a first yarn) of 75 total denier composed of 36 filaments, false-twist textured polyester yarns (a second yarn) of 50 total denier composed of 24 filaments, and non-textured polyester multi-filament yarns (a third yarn) of 50 total denier composed of 48 filaments are respectively arranged in front, back, and middle guide bars of the machine, in turn, whereby a three-layered fabric having a surface layer of the first yarn, a middle layer of the second yarn, and a back layer of the third yarn was obtained.

The greige fabric was subjected to successive raising, shearing, refining, and heat-setting processes, in turn. But the raising and shearing treatment were only given to only a surface of the back layer of the knitted fabric.

An ink spot test was carried out on a test piece from the finished fabric in the same manner as described in Example 1. The results show good water-permeability and diffusibility as well as effective water-holding ability of the surface layer.

EXAMPLE 6

Figure 10:
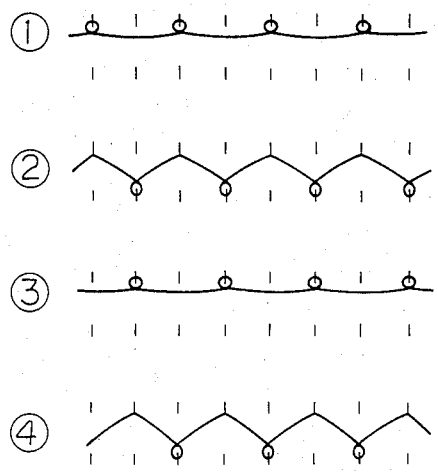
FIG. 10 is a further knitting construction of a double jersey according to the present invention.

A double jersey was produced according to a knitting construction for a reversible knit shown in FIG. 10 by a 22 gauge interlock circular knitting machine having 4 feeders. Non-textured polyester multi-filament yarns of 150 total denier composed of 48 filaments were fed to first and third feeders so as to constitute a surface layer. On the other hand, false-twist textured yarns having the same filament composition as the former were fed to second and fourth feeders so as to constitute a back layer. The greige fabric thus obtained was finished according to the conventional manner.

An ink spot test was carried out on the finished fabric in the same manner as described in Example 1 and showed good results.

EXAMPLE 7

A double jersey was produced by the same knitting construction and knitting machine utilized in Example 6, except for using spun yarns of 32 cotton count composed of polyester staple fiber of 2.0 denier and 51 mm length instead of the textured polyester yarn for the back layer. This spun yarn functioned as a connecting yarn between the back and surface layers.

The fabric was finished according to the conventional manner as shown in Example 1. The same test was carried out on the finished fabric as described in Example 1 and showed good results.

EXAMPLE 8

A double jersey was produced by the same knitting construction and knitting machine as shown in Examples 6 and 7. However, in this example, non-textured multi-filament nylon yarns of 140 total denier composed of 34 filaments were used as a surface layer yarn, and false-twist textured yarns of the same were used as a back layer yarn. The latter yarn formed a back layer of the jersey as well as a connecting yarn binding the back and surface layers thereof.

The fabric was finished in the same manner as shown in Example 1. The same test was carried out on the resultant fabric as described in Example 1 and showed good results.

EXAMPLE 9

A conventional textured yarn A was produced by means of a solid stretching type false-twist texturing machine having double heaters from a polyester filament yarn of 150 total denier composed of 96 filaments. The obtained textured yarn A was further treated by means of an air nozzle for ejecting a high speed fluid jet, as disclosed in Japanese Examined Patent Publication (Kokoku) No. 53-18614. The treatment was carried out twice with varying levels of air pressure applied to the air nozzle, whereby two interlaced yarns B and C having interlaced portions of 142/m and 96/m, respectively were obtained. In the above treatment, an air jet was perpendicularly applied to the yarn under the pressures shown below:

3.0 kg/cm$^2$ to yarn B 2.0 kg/cm$^2$ to yarn C

Figure 11:
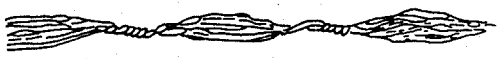
FIG. 11 is a side view of part of an interlaced yarn suitable for forming a surface layer of the fabric according to the present invention.

The configuration of the resultant yarn is illustrated in FIG. 11.

Next, three double jerseys of reversible knit were produced by a 22 gauge interlock circular knitting machine having 8 feeders, the yarn arrangement of which is listed in Table 4. The greige fabrics were finished in the conventional manner.

Figure 12:
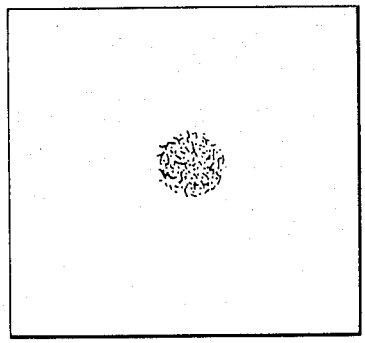
FIGS. 12 and 13 are sketches showing results of the ink spot test in Example 9.
Figure 13:
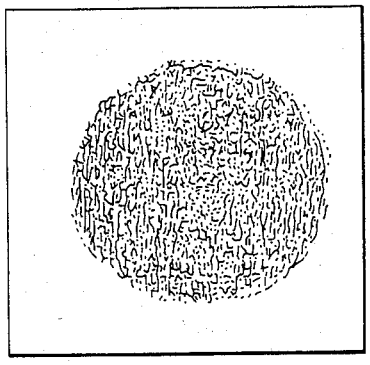

An ink spot test was carried out on the finished fabrics. Sketches of the ink spots on the back and surface layers of the best fabric (Test No. 1) are given in FIGS. 12 and 13, respectively. FIG. 12 shows the back layer of the test piece and a black portion thereof in the central part shows the ink remaining on the back layer. On the other hand, FIG. 13 shows the surface layer of the test piece that is a surface layer which contacts with open air. It is apparent from the Table 4, Test Nos. 1 and 2 in which the interlaced yarn was used in the surface layer show more remarkable water surface spreading ability comparing with that of Test No. 3.

TABLE 4

| Test No. | Yarn arrangement | | Area of ink spot on surface layer |
|---|---|---|---|
| | Surface layer | Back layer | |
| 1 | Yarn B | Yarn A | 28 cm$^2$ |
| 2 | Yarn C | Yarn A | 22 |
| 3(Blank) | Yarn A | Yarn A | 13 |

EXAMPLE 10

A conventional textured yarn was produced by means of the same texturing machine as utilized in Example 9 from a polyester filament yarn of 75 total denier composed of 72 filaments. The obtained textured yarn was combined to a non-textured polyester multi-filament yarn of 50 total denier composed of 24 filaments. The composite yarn was treated by means of the air nozzle utilized in Example 9, in which an air jet of 2.5 kg/cm$^2$ (gauge pressure) is applied perpendicularly to the composite yarn. The thus obtained interlaced yarn had 88 interlaced portions per 1 m length.

Next, a double jersey was produced by the same knitting machine as Example 9 with the above interlaced yarn for forming a surface layer and a conventional polyester textured yarn of 100 total denier composed of 24 filaments for forming a back layer. The textured yarn also functioned as a connecting yarn between the two layers. The fabric thus obtained was finished to be a light blue fabric through a relaxing process of 98° C.×10 minutes and a dyeing process of 130° C.×60 minutes. The finished fabric had a compact structure, especially in surface layer, due to heat contraction during the dyeing process.

An ink spot test showed that the spots on the back and surface layers have diameters of 11 mm and 44 mm, respectively, evidence of good water-permeability and diffusibility.

I claim:

1. A knitted fabric specially adapted for use in clothing which comprises a layered structure having at least a first, inner yarn layer and a second, outer yarn layer, wherein said first yarn layer is to be disposed facing a wearer's body, and said second yarn layer is to be disposed on the side further from the wearer's body;

wherein each yarn layer is further comprised of a plurality of fibers, said fibers each being at least one denier and consisting essentially of non-hygroscopic fibers, wherein the inter-fiber spaces between neighboring individual non-hygroscopic fibers of the first yarn layer are larger than the interfiber spaces between the neighboring individual non-hygroscopic fibers of said second yarn layer, whereby perspiration in contact with said first yarn layer moves through said first yarn layer and into said second yarn layer by capillary action.

2. A knitted fabric according to claim 1, wherein the non-hygroscopic fiber is polyester.

3. A knitted fabric according to claim 1 wherein the non-hygroscopic fiber is polyolefin.

4. A knitted fabric according to claim 1 wherein the non-hygroscopic fiber is polyamide.

5. A knitted fabric according to claim 1 wherein the non-hygroscopic fiber is polyacrylonitrile fiber.

6. A knitted fabric according to claim 1 wherein said fabric consists of non-hygroscopic fibers.

7. A knitted fabric according to claim 6 wherein said non-hygroscopic fibers are polyester.

8. A knitted fabric according to claim 1, wherein said first yarn layer comprises the same or different yarn as is found in said second yarn layer and the relative difference in size between the inter-fiber spaces of neighboring individual fibers of said first yarn layer and said second yarn layer is the result of the knit construction of said fabric.

9. A knitted fabric according to claim 1, wherein the layered structure is formed by a plaiting knit arrangement of at least two yarns so that there is a relative difference in interfiber space between the fiber group of one yarn and that of the other yarn.

10. A knitted fabric according to claim 1, wherein at least one layer is formed by using a tuck knit construction more frequently than that of the other layer.

11. A knitted fabric according to claim 1, wherein at least one layer is formed by using an inlaid yarn construction.

12. A knitted fabric according to claim 1, wherein the yarn forming one layer is knitted into the other layer.

13. A knitted fabric according to claim 1, wherein the yarn forming the inner layer is connected into the outer layer, whereby a double jersey structure is formed.

14. A knitted fabric according to claim 1, wherein the fabric is a single jersey in which projected sinker loops are arranged to form the inner layer with a linear geometric pattern.

15. A knitted fabric according to claim 1, wherein said first yarn layer comprises coarser fibers and said second yarn layer comprises finer fibers such that the relative difference in size between the inter-fiber spaces of neighboring individual fibers of said first yarn layer and said second yarn layer is the result of the inter-fiber spaces occurring in the yarn employed in said layers.

16. A knitted fabric according to claim 1, wherein a yarn composing one layer thereof has a different twist number from that of a yarn composing the other layer.

17. A knitted fabric according to claim 1, wherein the fibers of a yarn layer have a plurality of interlaced portions.

18. A knitted fabric according to claim 1, wherein a yarn forming a layer is a yarn comprising a textured yarn and a non-textured yarn, wherein the fibers of said yarn have a plurality of interlaced portions.

19. A knitted fabric according to claim 1, wherein the yarn fibers of said second layer are within a range of from 1.0 denier to 2.5 denier and the denier of the yarn fibers of the first yarn layer is at least 1.5 times greater than the former.

20. A knitted fabric according to claim 19, wherein the filaments of a yarn are interlaced and the yarn has a plurality of interlaced portions in the longitudinal direction thereof.

21. A knitted fabric according to claim 20, wherein the interlaced yarn is composed of a textured yarn and a non-textured multifilament yarn.

22. A knitted fabric according to claim 1, wherein the fibers of said first yarn layer are approximately within the range of 4–6 denier and the fibers of said second yarn layer are approximately within the range of 1–2 denier.

23. A knitted fabric according to claim 1, wherein the fibers of said first yarn layer are approximately 50% thicker than the fibers of said second yarn layer.

24. A knitted fabric according to claim 1, wherein the inner layer has a plush-like appearance.

* * * * *